United States Patent [19]

Morrison

[11] 3,936,127

[45] Feb. 3, 1976

[54] LAMP MOUNTING ASSEMBLY

[75] Inventor: Charles R. Morrison, Frewsburg, N.Y.

[73] Assignee: Truck-Lite Company, Inc., Jamestown, N.Y.

[22] Filed: Jan. 11, 1974

[21] Appl. No.: 432,639

[52] U.S. Cl. ..... 339/97 L; 240/8.2

[51] Int. Cl.[2] ..... H01R 13/38

[58] Field of Search ..... 339/14, 95, 97–99, 339/176 L, 177 L; 240/8.2

[56] References Cited

UNITED STATES PATENTS

| | | | |
|---|---|---|---|
| 3,226,537 | 12/1965 | Hanson et al. | 240/8.2 |
| 3,581,080 | 5/1971 | Magi | 240/8.2 |
| 3,742,429 | 6/1973 | Morrison | 339/97 L |
| 3,813,535 | 5/1974 | Freeman | 339/97 L |

*Primary Examiner*—Joseph H. McGlynn
*Attorney, Agent, or Firm*—Clarence A. O'Brien; Harvey B. Jacobson

[57] ABSTRACT

The reflector mounting member of a lamp is provided with a receptacle formation in which the lamp bulb base is seated and retainer formations in which a pair of connector devices are seated. One or two insulated conductor cables are inserted into the connector devices to thereby pierce the insulation and establish electrical connections through the connector devices to the bulb filaments.

6 Claims, 5 Drawing Figures

LAMP MOUNTING ASSEMBLY

This invention relates to lamp assemblies for vehicles and other mobile installations.

A relatively inexpensive and easily assembled lamp assembly is disclosed in my prior U.S. Pat. No. 3,742,429, issued June 26, 1973, wherein an electrical power cable is inserted into an insulation piercing connector to establish a grounded electrical circuit through the filament of an incandescent bulb. A ground connection is established through a ground strap anchored to the reflector by a grounding fastener. Such a lamp assembly is not suitable for a two wire power system present, for example, in mobile homes and trailers. It is therefore an important object of the present invention to extend the benefits and advantages of the aforementioned type of lamp assembly to the mobile home and trailer market, in a new and unique manner.

In accordance with the present invention, a reflector mounting member is formed with a bulb base receiving receptacle and retaining formation for a power cable piercing connector, as disclosed in my prior U.S. patent aforementioned. Additional formations project from the reflector on the side of the receptacle formation opposite the retainer formation to hold a second, insulation piercing connector into which a ground wire conductor is adapted to be inserted. The additional formations cooperate with the bulb receptacle formation to position the ground cable connector which includes a bulb base embracing strap and a flat ground strap interconnected with an intermediate scarfing section adapted to slice through and pierce the insulation of a conductor inserted therein.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
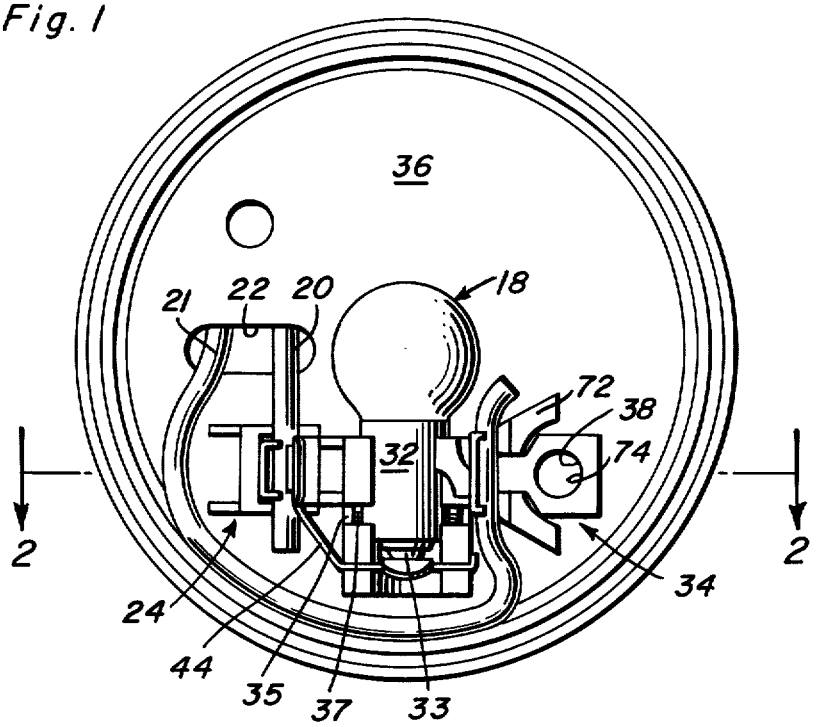
FIG. 1 is a top plan view of a lamp assembly constructed in accordance with the present invention with the lens cover removed.
Figure 2:
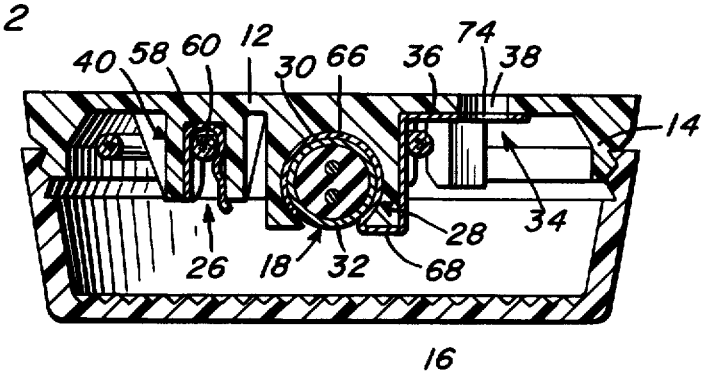
FIG. 2 is a transverse sectional view taken substantially through a plane indicated by section line 2—2 in FIG. 1.

Referring now to the drawings in detail, and initially to FIGS. 1 and 2, a vehicle lamp assembly generally denoted by reference numeral 10 is shown. The lamp assembly includes a reflector mounting member 12 made of an electrically non-conductive, plastic material having an annular rim portion 14 receiving a suitable lens cover 16 through which illumination is emitted from a conventional type of base bulb 18 when energized by electrical energy supplied thereto from a suitable source by means of a hot line conductor cable 20.

In the embodiment illustrated by way of example, the hot line conductor 20 is part of a two-wire system which also includes a ground cable 21. Both cables 20 and 21 extend into the lamp assembly through an opening 22 in the reflector member 12 and are respectively engaged by insulation piercing connectors 24 and 34.

With continued reference to FIGS. 1 and 2, the reflector mounting member 12 is provided with a bulb holding receptacle formation 28 having an axially extending arcuate recess 30 within which the base portion 32 of the bulb is seated. Pins 37 extending from the base portion are seated in slots 35 to maintain radial and axial alignment of the bulb in the bulb holder 28. The base portion of the bulb is in contact with connector 34 to be described in detail hereafter, which extends along one side of receptacle formation 28 along the flat portion 36 of the reflector 12 to an opening 38. An electrically conductive grounding fastener may be used to anchor the lamp assembly through opening 38 only if a single wire system is used.

The reflector member 12 is provided with a receptacle formation 40 spaced from an opposite side of the bulb receiving formation 28. The clip portion 26 of the power connector is received within the recess 42 of a retainer formation 40 through which the hot line conductor 20 extends. An integral arm portion 44 as shown in FIG. 1, extends from one side of the clip portion 26 and is received in slots 41 of the bulb holder 28 engaging the end terminal 33 of the bulb when seated in its aligned position. In this fashion, an electrical circuit is completed to ground from the power conductor 20 through the bulb filament.

Figure 4:
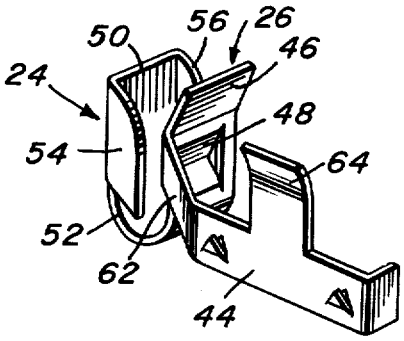
FIG. 4 is a perspective view of the power cable connector.

Referring now to FIGS. 1, 2 and 4, the power connector 26 is formed from an integral, electrically conductive sheet of material. The clip portion 26 is provided on one side with a jaw 46 from which an arcuate projection 48 extends toward a confronting jaw section 50 of the clip portion, the jaws being interconnected by an elastically deformable arcuate section 52 adapted to be seated within the recess 42 of the retainer formation 40 aforementioned. The jaw sections 46 and 50 are elastically deflected away from each other when the hot line conductor cable is inserted and wedged therebetween. When inserted, the hot line conductor cable is engaged on one side by the projection 48 and on the other side by a pair of parallel spaced scarfing elements 54 that extend from the jaw section 50. The knife edges 56 of the scarfing elements accordingly slice into the insulating sheathing 58 of the conductor 20 as shown in FIG. 2 as the cable is inserted between the jaws in order to establish contact with the conductive core 60. An electrical connection is thereby established through the power connector to the end terminal of the lamp bulb and because of the spring action of the clip and the rigid back-up of formation 40, electrical circuit continuity is maintained.

With continued reference to FIGS. 1, 2 and 4, the arm portion 44 of the power connector extends from one axial edge of the jaw section 46 and includes a section 62 disposed at a predetermined angle so that the contact tab 64 projecting from the arm portion 44 is substantially perpendicular to the axis of the recess 30 closing one axial end of the formation 28. The end terminal of the bulb engages the contact tab 64. The power connector is made of a suitable spring or elastically deformable material in order to establish firm contact with both the bulb terminal and the conductor through the clip portion 24 as aforementioned.

Figure 5:
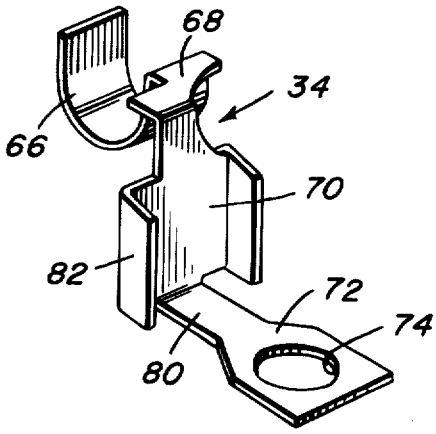
FIG. 5 is a perspective view of the ground cable connector.

Referring now to FIGS. 1, 2 and 5, the ground connector 34 includes an arcuate strap portion 66 adapted to line the bulb base receiving recess 30 at one axial end opposite the end adjacent slots 41. The base embracing portion 66 is connected by a bridging portion 68 to a laterally offset web portion 70 adapted to be positioned in abutment with the receptacle formation 28. A flat strap portion 72 extends from the web 70 along the flat portion 36 of the reflector and is provided with an opening 74 adapted to be aligned with opening 38 in the reflector.

Figure 3:
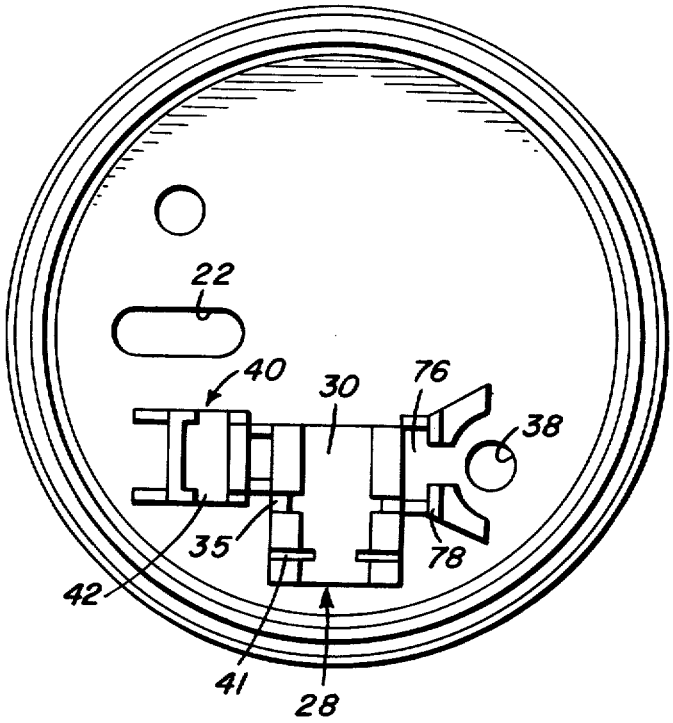
FIG. 3 is a top plan view of the reflector itself.

The web 70 is held in abutment with the receptacle formation 28 by positioning thereof in a channel 76 as shown in FIG. 3, formed between one side of formation 28 and a pair of spaced posts 78. A narrow neck 80 of the flat strap 72 extends from the web 70 between the retainer post formations 78 which diverge partially about the opening 38 to retain the flat strap 72 in place.

A pair of scarfing flanges 82 project from the web 70 into the channel 76 so as to pierce the insulation of the ground cable when inserted into the channel, by a slicing action. A firm physical and electrical connection is thereby established. As in the case of power connector 24, no tools are required for making the ground connection.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. In combination with a lamp reflector having a receptacle formation partially surrounding and frictionally retaining a lamp bulb adapted to be electrically connected to an insulation covered conductor, retainer means projecting from the reflector in spaced relation to said receptacle formation, connector means seated in said retainer means for piercing insulation of a conductor inserted therein to electrically connect the same to the bulb, and a contact arm extending from the connector means and positioned by the receptacle formation for operative engagement with the bulb, said connector means including a pair of insulation piercing elements, a web portion interconnecting said elements in spaced relation and in abutment with the receptacle formation, and a bulb base embracing strap extending from the web portion into the receptacle formation.

2. The combination of claim 1 including a grounding strap extending from the web portion in a direction opposite to the base embracing strap.

3. In combination with a lamp reflector having a receptacle formation partially surrounding and frictionally retaining a lamp bulb adapted to be electrically connected to an insulation covered conductor, retainer formations projecting from the reflector on opposite sides of said receptacle formation, and connector means seated in each of said retainer formations for piercing insulation of a conductor inserted therein to electrically connect the same to the bulb, one of the retainer formations including a pair of post sections spaced from the receptacle formation to form a channel in which one of the connector means is seated in abutment with the receptacle formation.

4. The combination of claim 3 wherein one of the connector means includes a contact arm extending from one of the retainer formations through the bulb receptacle formation, and including means for positioning the contact arm within the receptacle formation in operative contact with the lamp bulb.

5. The combination of claim 3 wherein one of the connector means includes a pair of insulation piercing elements, a web portion interconnecting said elements in spaced relation within the channel, and a bulb base embracing strap extending from the web portion into the receptacle formation.

6. The combination of claim 5 including a grounding strap extending from the web portion between said post sections.

* * * * *